US007717035B1

(12) United States Patent
Gray

(10) Patent No.: US 7,717,035 B1
(45) Date of Patent: May 18, 2010

(54) EMBOSSING APPARATUS AND METHOD FOR MOUNTING EMBOSSING PLATES

(75) Inventor: Thomas Charles Gray, Coral Springs, FL (US)

(73) Assignee: Carey Color, Inc.

( * ) Notice: Subject to any disclaimer, the term of this patent is extended or adjusted under 35 U.S.C. 154(b) by 362 days.

(21) Appl. No.: 11/707,283

(22) Filed: Feb. 16, 2007

(51) Int. Cl.
*B31F 1/07* (2006.01)

(52) U.S. Cl. ..... 101/23; 101/28; 101/32

(58) Field of Classification Search ..... 101/22, 101/23, 24, 25, 28, 31, 32, 481, 248, 3.1, 101/395, 5, 6; *B31F 1/07*
See application file for complete search history.

(56) References Cited

U.S. PATENT DOCUMENTS 3,320,876 A * 5/1967 Salvatore ..... 101/23
4,116,594 A * 9/1978 Leanna et al. ..... 425/3
4,309,804 A * 1/1982 Sarka ..... 29/407.04
4,498,390 A * 2/1985 Bowling et al. ..... 101/365
4,831,930 A * 5/1989 Leanna ..... 101/389.1
4,871,631 A * 10/1989 Pieper et al. ..... 430/14
4,913,858 A * 4/1990 Miekka et al. ..... 264/1.34
5,379,019 A * 1/1995 Fiddes et al. ..... 335/216
5,626,076 A * 5/1997 Ireton ..... 101/401.1
6,766,733 B1 * 7/2004 Collins ..... 101/28

FOREIGN PATENT DOCUMENTS

EP 836928 A1 * 4/1998

* cited by examiner

*Primary Examiner*—Ren Yan
*Assistant Examiner*—Jennifer Simmons
(74) *Attorney, Agent, or Firm*—Gold & Rizvi, P.A.; Glenn E. Gold; H. John Rizvi

(57) ABSTRACT

An apparatus for embossing a substrate is provided. The apparatus includes a die with a metal backing layer that carries a polymer layer. The polymer layer has a female pattern formed through laser engraving. The metal backing layer of the die is capable of being magnetically attached to a magnetic cylinder. A counter die is also included and has a metal backing layer that carries a polymer layer. The polymer layer has a male pattern formed thereon through laser engraving. The metal backing layer of the counter die is capable of being magnetically attached to a magnetic cylinder. An alternative apparatus is provided that includes a male and female starting member to aid in aligning the patterns. Another apparatus is included that has male and female register tracts for keeping the die and counter die in register with one another. An associated method is also provided.

4 Claims, 8 Drawing Sheets

EMBOSSING APPARATUS AND METHOD FOR MOUNTING EMBOSSING PLATES

FIELD OF THE INVENTION

The present invention relates generally to an apparatus and method for embossing a substrate. More particularly, the present application involves an embossing apparatus and method that include a pair of embossing plates for creating a clean and sharp embossing in line as a one pass process.

BACKGROUND

Embossing involves the creation of a three-dimensional image in a substrate such as paper, foil, laminate or other ductile material. The process involves passing the substrate through a nip formed by a die and a counter die. The die is sometimes referred to as a female die and has a desired pattern formed therein. The counter die, often called a male die, has a matching pattern that is received into the pattern of the die. The substrate is passed between the die and counter die and through a combination of heat and pressure has the desired pattern formed thereon. The pattern is formed at a level above that of the surrounding substrate. Although finding utility in a variety of applications, embossing is commonly applied to seals, postage stamps, and labels for food, beverages, cosmetics, cigars and wine.

One type of device currently used to form an embossing is a rotary device that includes a pair of hard embossing rolls that are cylindrical in shape. The rolls are typically made of steel or brass and have the desired pattern etched thereon. Although this type of device is capable of forming an embossing on a substrate, the cost for such a device is high and it generally takes a long amount of time to machine these types of rolls. Further, the cost to ship such a set of cylindrical rolls is high due to their weight and size.

An additional method of embossing currently used is photopolymer embossing. This process makes use of a pair of photopolymer embossing plates, that have a desired image imparted thereon, that are mounted to a pair of adjacent cylinders by double sided mounting tape. After application, one of the cylinders acts as a die and the other acts as a counter die. The substrate can be fed through the nip formed by the pair of photopolymer embossing plates to have an embossing formed thereon. Although this type of process works well for its intended purpose, embossing formed by photopolymer embossing plates generally has a low profile and poor edges. Also, this embossing technique is limited to forming only a two dimensional embossing and cannot form a three dimensional embossing. Further, adhesive on the double sided tape used to apply the photopolymer embossing plates to the cylinders is susceptible to breaking down and causing the photopolymer embossing plates to detach.

Another current process used to form an embossing employs a photopolymer metal backed embossing plate. This plate is a male die and is attached to a magnetic cylinder to be held thereon. A female die is not used. Instead, a rubber roller forms a nip with the photopolymer metal backed embossing plate and pushes the substrate down on top of this plate to form a two dimensional embossing thereon. Although this type of method is capable of forming an embossing, the resulting product generally has a very low profile in addition to poor height and edges.

It is also possible to create an embossing through the use of flat plates. These plates are generally made of brass, copper or magnesium. Male and female patterns are etched into the plates, and the substrate is positioned between the plates in order to be embossed. Embossing tools of this type are costly and are not suited for various types of manufacturing processes. As such, there remains room for variation and improvement within the art.

SUMMARY

Various features and advantages of the invention will be set forth in part in the following description, or may be obvious from the description, or may be learned from practice of the invention.

One aspect of the present invention provides for an apparatus for embossing a substrate that includes a die with a metal backing layer that carries a polymer layer. The polymer layer has a female pattern formed thereon through the use of laser engraving. The metal backing layer is capable of being magnetically attached to a magnetic cylinder. A counter die is also included and has a metal backing layer that carries a polymer layer. The polymer layer of the counter die has a male pattern formed thereon through the use of laser engraving. The metal backing layer of the counter die is capable of being magnetically attached to a magnetic cylinder.

Another aspect of the present invention is found in an apparatus as immediately mentioned in which the polymer layer of the die is a carbon rubber compound. Further, the polymer layer of the counter die is a carbon rubber compound.

A further aspect of the present invention is found in an apparatus as discussed above that further includes a female magnetic cylinder. The female magnetic cylinder has at least one row of neodymium magnets for attracting the metal backing layer of the die to magnetically attach the die to the female magnetic cylinder. A male magnetic cylinder is also present and has at least one row of neodymium magnets. The magnets are used for attracting the metal backing layer of the counter die to magnetically attach the counter die to the male magnetic cylinder.

An additional aspect of the present invention resides in an apparatus as previously mentioned in which the polymer layer of the die has a female starting member formed thereon. The polymer layer of the counter die has a male starting member formed thereon. The male starting member is receivable into the female starting member in order to engage the die and counter die at a proper starting point. Proper engagement allows the female pattern of the die to be properly received with the male pattern of the counter die during rotation of the die and counter die.

A further aspect of the present invention is provided in an apparatus as discussed above in which the polymer layer of the die has a female register tract formed thereon. The polymer layer of the counter die has a male register tract formed thereon. The male register tract is receivable into the female register tract in order to maintain the die and counter die in register with one another during rotation of the die and counter die.

Another aspect of the present invention exists in an apparatus for embossing a substrate that has a die. The die has a polymer layer that has a female pattern thereon. The die is capable of being attached to a cylinder. The polymer layer of the die has a female starting member thereon. A counter die that has a polymer layer with a male pattern thereon is also present. The counter die is capable of being attached to a cylinder. The polymer layer of the counter die has a male starting member thereon. The male starting member is receivable into the female starting member in order to engage the die and counter die at a proper starting point so that the female pattern of the die is properly received with the male pattern of the counter die during rotation of the die and counter die.

Also provided in accordance with one aspect of the present invention is an apparatus as immediately described in which the polymer layer of the die has a second female starting member thereon. The polymer layer of the counter die has a second male starting member thereon. The second male starting member is receivable into the second female starting member in order to engage the die and counter die at a proper starting point so that the female pattern of the die is properly received with the male pattern of the counter die during rotation of the die and counter die.

The present invention also provides for in an additional aspect an apparatus for embossing a substrate that has a die. The die has a polymer layer that has a female pattern thereon. The die is capable of being attached to a cylinder. The polymer layer of the die has a female register tract thereon. A counter die is present and has a polymer layer that has a male pattern thereon. The counter die is capable of being attached to a cylinder. The polymer layer of the counter die has a male register tract thereon. The male register tract is receivable into the female register tract in order to maintain the die and counter die in register with one another during rotation of the die and counter die.

Also provided in accordance with another aspect of the present invention is an apparatus as immediately mentioned in which the male and female register tracts have an elongated rectangular shaped component with spokes extending perpendicular to the direction of elongation. The male register tract is located outside of the pattern of the polymer layer of the counter die. The female register tract is located outside of the pattern of the polymer layer of the die.

An additional aspect of the present invention is provided in an apparatus as discussed above in which the polymer layer of the counter die has a second male register tract thereon. The polymer layer of the die has a second female register tract thereon. The second male register tract is receivable into the second female register tract in order to maintain the die and counter die in register with one another during rotation of the die and counter die.

Another aspect of the present invention exists in a method of mounting a die and a counter die for use in embossing. The method includes the steps of providing a die with a metal backing layer that carries a polymer layer. The polymer layer has a female pattern thereon. A counter die with a metal backing layer that carries a polymer layer is also provided. The polymer layer has a male pattern thereon. The method also includes the steps of providing a female magnetic cylinder and a male magnetic cylinder. The metal backing layer of the die is magnetically attached to the female magnetic cylinder. The metal backing layer of the counter die is magnetically attached to the male magnetic cylinder. The polymer layers of the die and counter die form a nip.

Another aspect of the present invention resides in a method as immediately discussed that further involves engaging a male starting member on the polymer layer of the counter die to a female starting member on the polymer layer of the die. A male register tract is engaged on the polymer layer of the counter die to a female register tract on the polymer layer of the die.

A further aspect of the present invention exists in a method as described above in which a leading edge of the die is taped to a leading edge of the counter die. The counter die is engaged onto a register location of the male magnetic cylinder. The female magnetic cylinder and male magnetic cylinder are rotated so that the leading edges of the die and counter die are passed through a nip formed by the male magnetic cylinder and female magnetic cylinder. The tape is removed from the leading edges of the die and counter die. The female magnetic cylinder and male magnetic cylinder are rotated so that the step of magnetically attaching the metal backing layer of the die to the female magnetic cylinder and the step of magnetically attaching the metal backing layer of the counter die to the male magnetic cylinder is accomplished.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
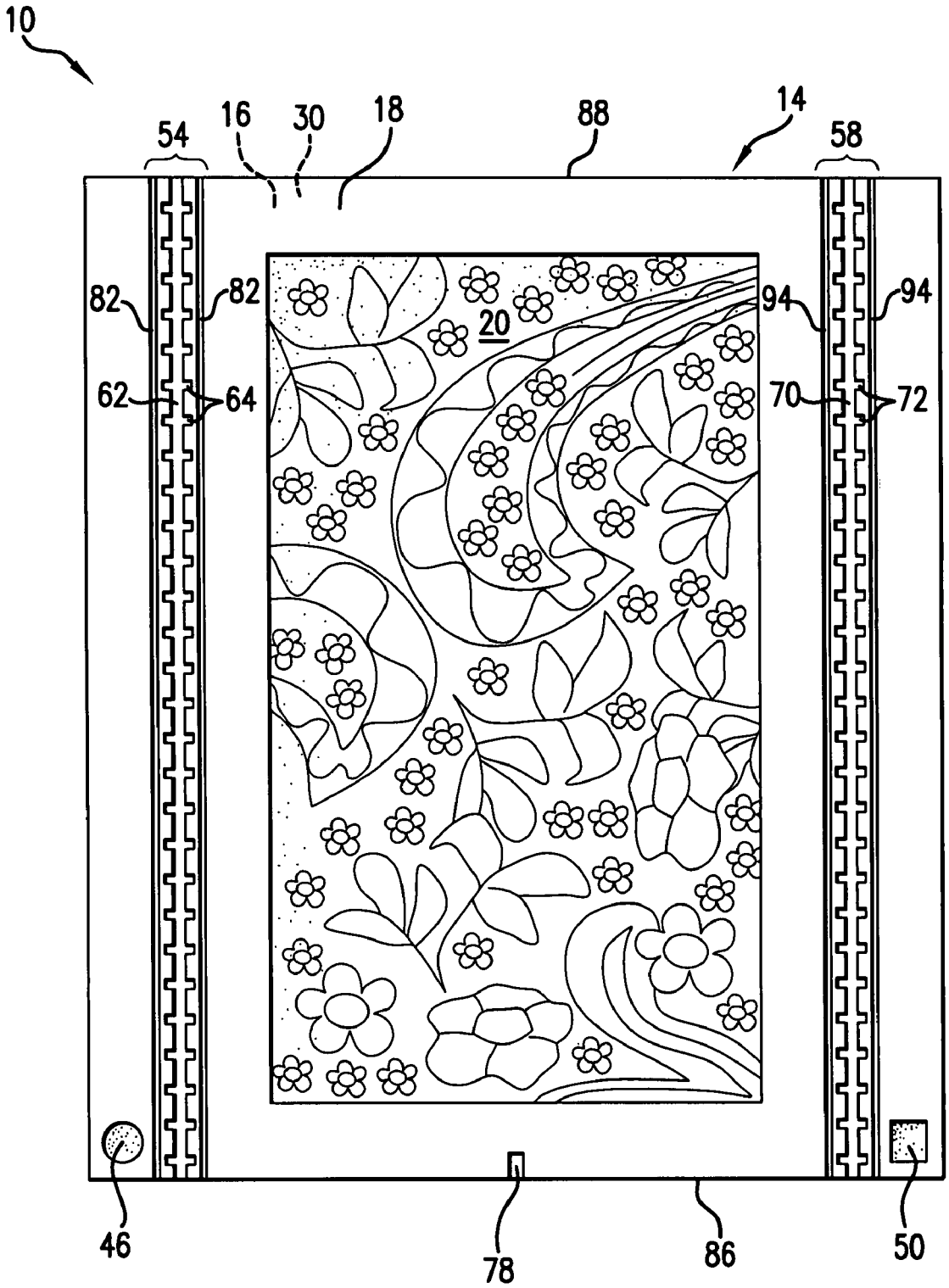
FIG. 1 is a front view of a die with a female pattern in accordance with one exemplary embodiment of the present invention.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for an apparatus 10 capable of creating an embossing 44 in a substrate 12. The apparatus 10 includes a die 14 and a complimentary counter die 22 between which the substrate 12 passes in order to have the embossing 44 imparted thereon. A female starting member 46 and a male starting member 48 can be included in order to properly position the die 14 and counter die 22 when mounted onto cylinders 34 and 38. Further, a female register tract 54 and a male register tract 56 can be incorporated into the die 14 and counter die 22 in order to cause these two components to register properly when rotating in unison on the cylinders 34 and 38. In accordance with various exemplary embodiments of the present invention, the die 14 and counter die 22 can be magnetically attached to a female magnetic cylinder 34 and a male magnetic cylinder 38. Further embodiments exist in which a female pattern 20 formed on the die 14 and a male pattern 28 formed on the counter die 22 are thus formed through the use of laser engraving.

Figure 2:
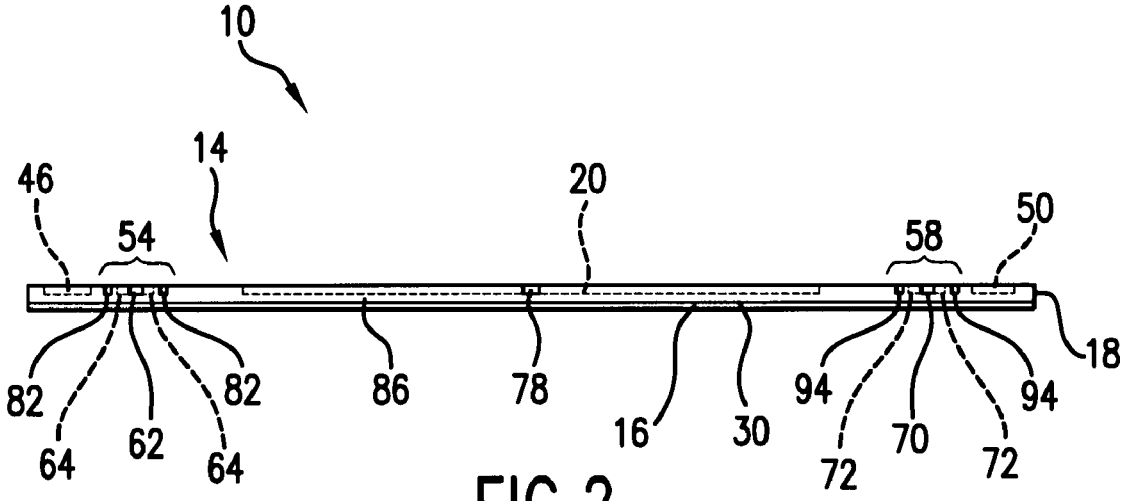
FIG. 2 is a side view of the die of FIG. 1.

An apparatus 10 in accordance with one exemplary embodiment of the present invention includes a die 14 as shown in FIGS. 1 and 2. Die 14 may include a metal backing layer 16 that carries a polymer layer 18. The polymer layer 18 may be rubber in accordance with one exemplary embodiment. In accordance with yet another exemplary embodiment polymer layer 18 may be a carbon rubber compound. The polymer layer 18 can be attached to the metal backing layer 16 in a variety of manners. For example, the polymer layer 18 can be bonded to the metal backing layer 16 with adhesive 30 under heat or alternatively in a cold mounting bonding process in accordance with various embodiments. The polymer layer 18 has a female pattern 20 of a shape desired to be imparted onto a substrate 12 in an embossing process. The female pattern 20 can be formed into the polymer layer 18 or may be carried thereon in accordance with various exemplary embodiments. In one embodiment, the female pattern 20 is formed into the polymer layer 18 through the use of laser engraving.

Figure 4:
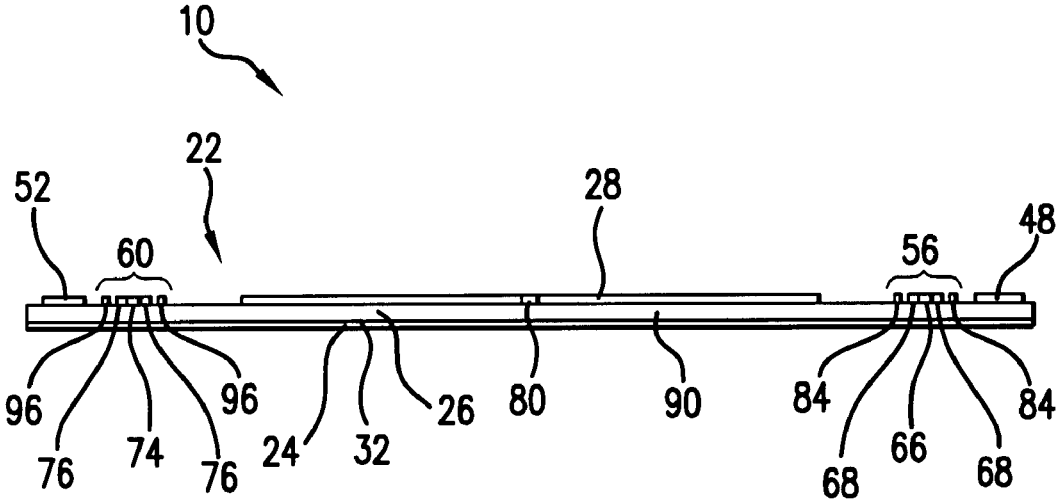
FIG. 4 is a side view of the counter die of FIG. 3.
Figure 3:
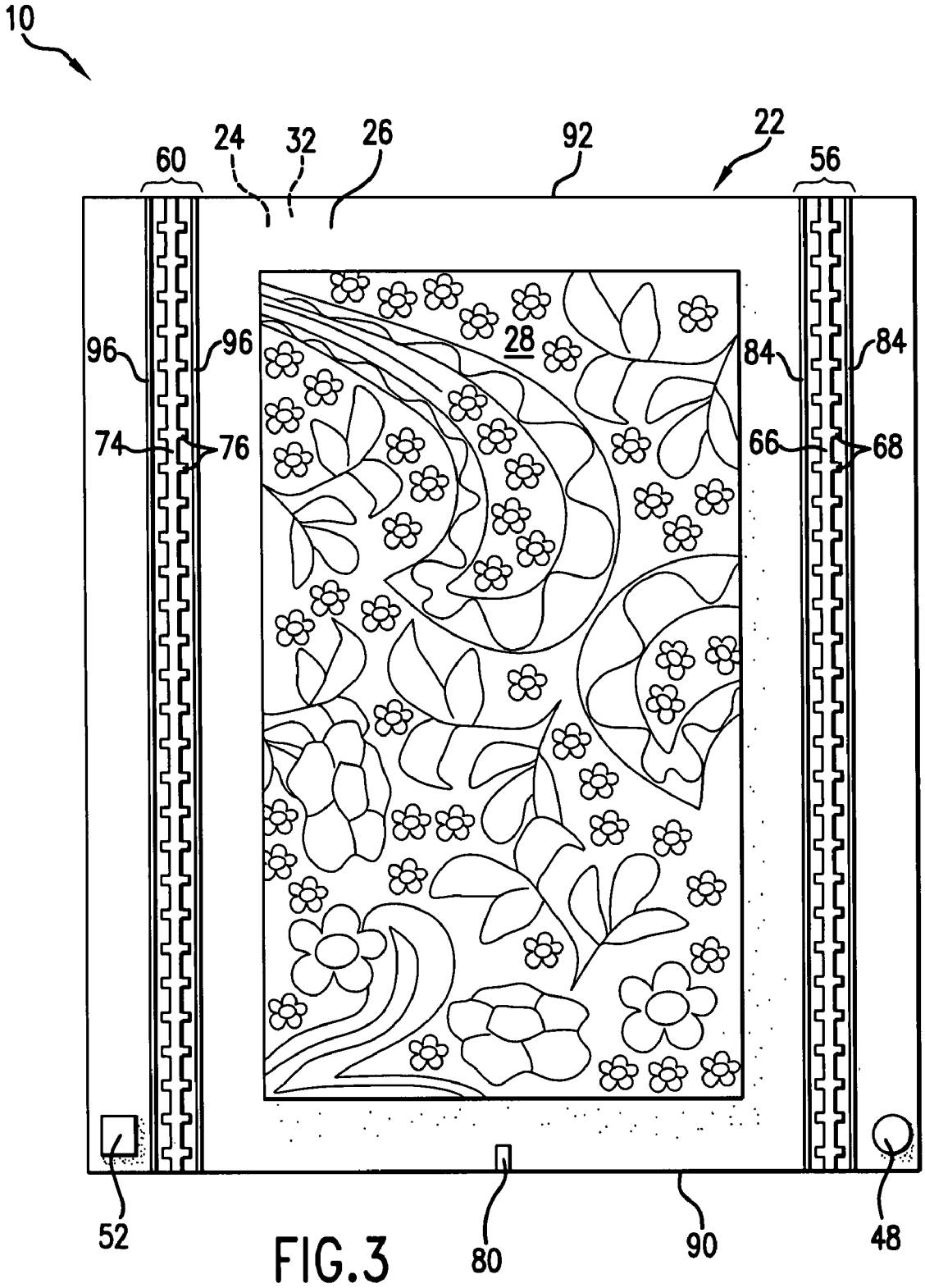
FIG. 3 is a front view of a counter die with a male pattern in accordance with one exemplary embodiment of the present invention.

FIGS. 3 and 4 show a counter die 22 of an apparatus 10 in accordance with one exemplary embodiment of the present invention. Counter die 22 may have a metal backing layer 24 that carries a polymer layer 26. As described above with respect to die 14, polymer layer 26 may be rubber and may be attached to the metal backing layer 24 in a variety of manners such as through the use of an adhesive 32. Also, polymer layer 26 may be a carbon rubber compound in certain exemplary embodiments. The polymer layer 26 has a male pattern 28 formed thereon. As previously discussed, the male pattern 28 can be integral to the polymer layer 26 or may be a separate component that is attached thereto. The male pattern 28 is formed through the use of laser engraving in accordance with one exemplary embodiment. Male pattern 28 is complimentary of female pattern 20 and is used in order to provide a desired embossing 44 into substrate 12.

Die 14 and counter die 22 can include a number of features to aid in their mounting. For example, die 14 can be provided with a female starting member 46 located outside of the female pattern 20. A second female starting member 50 and a third female starting member 78 are also included. As shown, the female starting member 46 is circular in shape, second female starting member 50 is square in shape, and third female starting member 78 is rectangular in shape. It is to be understood, however, that other exemplary embodiments of the present invention are possible in which the aforesaid members are provided with different shapes. Also, although shown as being outside of the female pattern 20, any one of or all of the female starting members 46, 50 and/or 78 can be located in pattern 20 in accordance with other embodiments.

Figure 5:
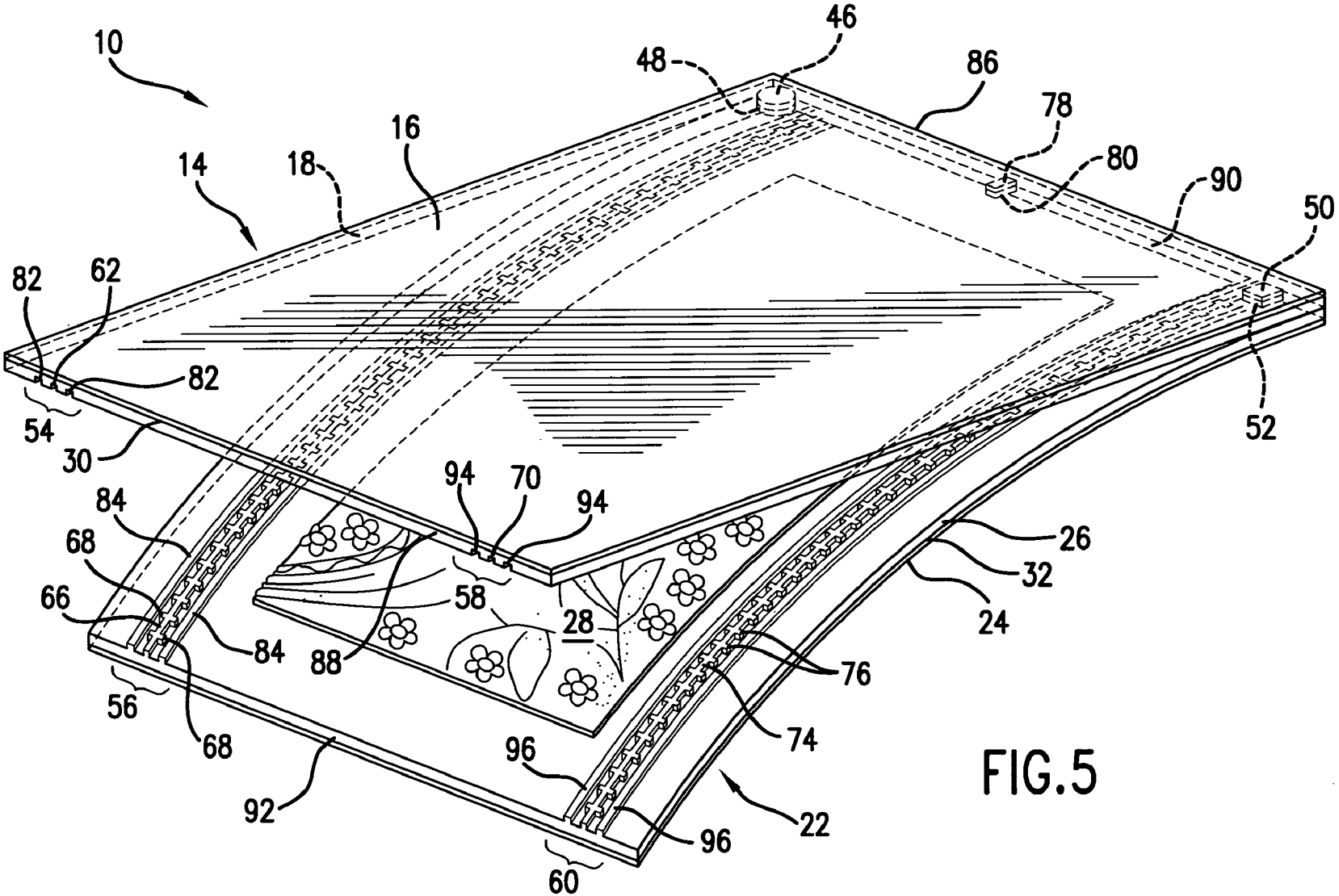
FIG. 5 is a perspective view of the die and counter dies of FIGS. 1-4 with their starting members and register tracts engaged.

Polymer layer 26 of counter die 22 includes three male starting members 48, 52 and 80. Male starting member 48 is circular in shape, second male starting member 52 is square in shape, and third male starting member 80 is rectangular in shape and all of the starting members 48, 52 and 80 are located outside of male pattern 28. As with the female starting members 46, 50 and 78, the male starting members 48, 52 and 80 may be variously shaped and may be located in male pattern 28 in accordance with other exemplary embodiments. The starting members are configured to engage one another so that female starting member 46 engages male starting member 48, second female starting member 50 engages second male starting member 52, and third female starting member 78 engages third male starting member 80. The engaging starting members are complimentary to one another and their engagement is shown in FIG. 5. The starting members function to allow the die 14 and counter die 22 to engage one another at a proper starting point so that the female pattern 20 is properly received with the male pattern 28 when the die 14 and counter die 22 are engaged and rotated. Although described as having three starting members on each of the die 14 and counter die 22, other embodiments exist in which fewer or more starting members can be employed. For example only the female starting member 46 and male starting member 48 may be present in accordance with one exemplary embodiment.

Referring back to FIG. 1, die 14 is shown as having a female register tract 54 that extends from a leading edge 86 to a tailing edge 88. In other embodiments, the female register tract 54 may only extend a portion of the way between edges 86 and 88. Female register tract 54 is located outside of the female pattern 20 but may be located in female pattern 20 in other embodiments. Female register tract 54 includes an elongated rectangular shaped component 62 that has a plurality of spokes 64 that are evenly spaced from one another and are oriented perpendicular to the elongated rectangular shaped component 62. These features are located between a pair of elongated grooves 82 of the female register tract 54 that are parallel to one another. The elongated rectangular shaped component 62, spokes 64 and elongated grooves 82 may all be of the same depth or may have varying depths in accordance with other embodiments.

The female register tract 54 is designed to receive a male register tract 56 located on the polymer layer 26 of the counter die 22. The male register tract 56 extends from a leading edge 90 of the counter die 22 to a trailing edge 92. It is to be understood, however, that the male register tract 56 need not extend the entire length of polymer layer 26 in other embodiments but may instead extend a distance less than the distance from leading edge 90 to trailing edge 92. The male register tract 56 includes features similar to the female register tract 54. For example, the male register tract 56 has an elongated rectangular shaped component 66 that extends from leading edge 90 to trailing edge 92. A series of spokes 68 extend from the elongated rectangular shaped component 66 and are oriented perpendicular therewith. The spokes 68 are generally evenly spaced from one another in the direction from leading edge 90 to trailing edge 92. A pair of elongated rectangular shaped edges 84 is located on either side of the spokes 92 and elongated rectangular shaped component 66. The features 66, 68 and 84 of the male register tract 48 are received in respective features 62, 64 and 82 of the female register tract 46. The female and male register tracts 54 and 56 engage one another in order to maintain the die 14 and counter die 22 in register with one another during their rotation. This helps maintain correct alignment of the die 14 with counter die 22 so that female pattern 20 is properly aligned with male pattern 28 to create a desired embossing 44.

Again, it is to be understood that the configuration of the tracts 54 and 56 is only exemplary and that other variations are possible. For example, tracts 54 and 56 may be a series of evenly or unevenly spaced projections and depressions that are not continuous with one another and extend half way across the length of the edges 86 and 88 and across half way of the length of edges 90 and 92 in certain embodiments.

A second female register tract 58 can be included on polymer layer 18 and located so that the female pattern 20 is located between tracts 54 and 58. Although shown as having a second female register tract 58, the die 14 need only include a single tract 54 in certain embodiments. Alternatively, more than two register tracts can be included in other variations of the present invention. Additionally, it is to be understood that the shape of the various tracts can be different in other embodiments and that the disclosed shapes are only exemplary. The second female register tract 58 is shown to extend completely between the leading edge 86 and trailing edge 88 of die 14. Other variations are possible in which the second female register tract 58 extends only part way between the opposed edges 86 and 88. The second female register tract 58 includes features such as an elongated rectangular shaped component 70, spokes 72 and a pair of elongated grooves 94. Features 70, 72 and 94 can be provided, arranged or varied in the same manners discussed above with respect to the elongated rectangular shaped component 62, spokes 64 and the pair of elongated grooves 82 of the female register tract 54.

The second female register tract 58 receives a complimentary second male register tract 60 located on the polymer layer 26 of counter die 22. The register tracts 58 and 60 are receivable in order to maintain the die 14 and counter die 22 in register with one another during rotation. The second male register tract 60 extends completely between the leading edge 90 and trailing edge 92 of the counter die 22. Other variations are possible in which the second male register tract 60 extends less than the full distance between edges 90 and 92. The second male register tract 60 includes features such as an elongated rectangular shaped component 74, spokes 76 and a pair of elongated rectangular shaped edges 96. Features 74, 76 and 96 can be arranged in a similar manner, configuration or with variations similar to the elongated rectangular shaped component 66, spokes 68 and pair of elongated rectangular shaped edges 84 of the male register tract 56 as previously discussed.

Figure 6:
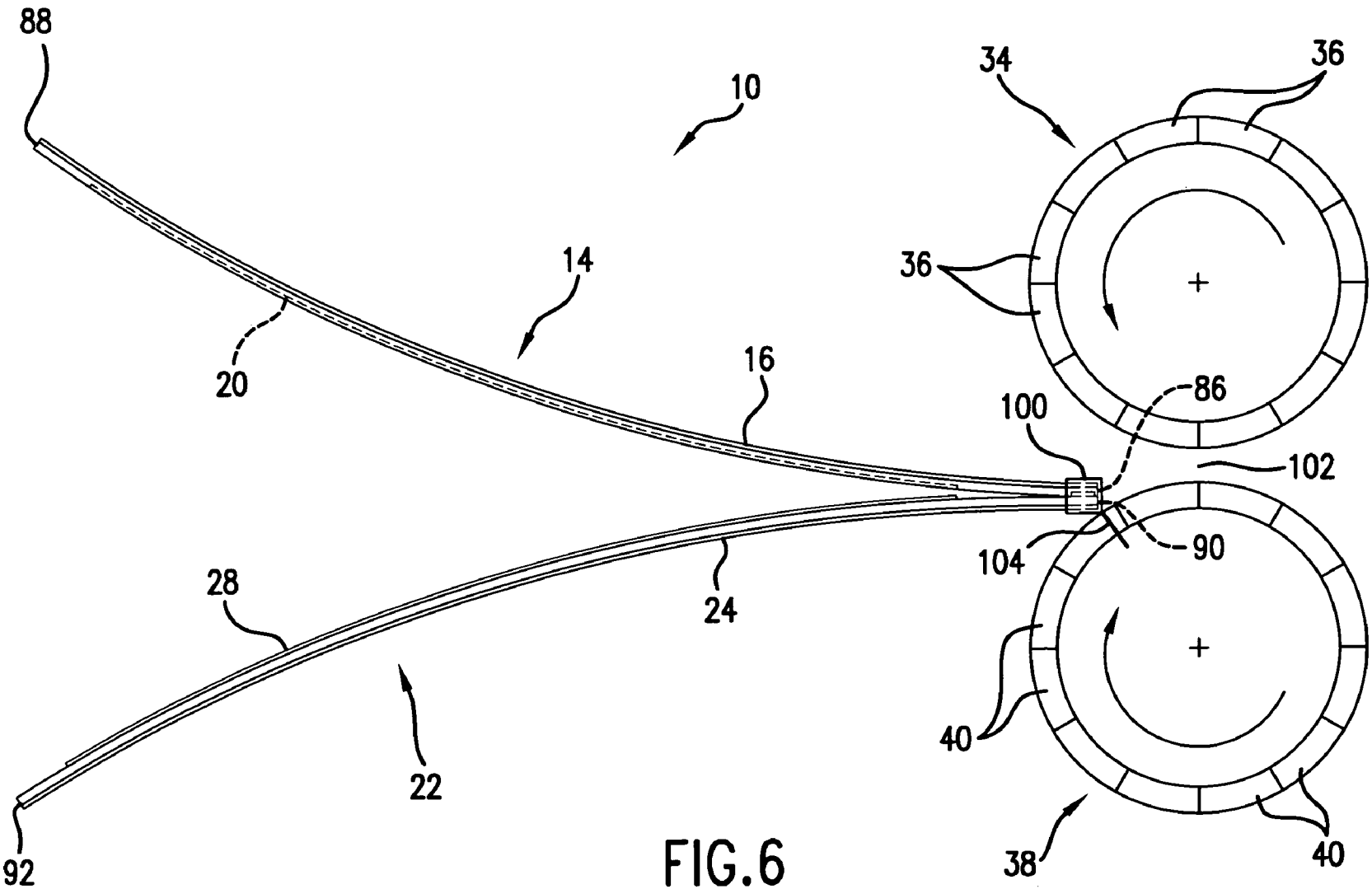
FIG. 6 is a side view of male and female cylinders with engaged die and counter dies with the leading edge of the counter die aligned with a register location of the male cylinder.

The die 14 and counter die 22 can be mounted onto a pair of cylinders 34 and 38 by first engaging the female starting member 46 and male starting member 48 in addition to the second female starting member 50 and the second male starting member 52. This engagement helps ensure the die 14 and counter die 22 are aligned and started properly. Additionally, the female register tract 54 and male register tract 56, as with the second female register tract 58 and second male register tract 60, will likewise be engaged. Next, as shown in FIG. 6, a piece of tape 100 can be applied to the leading edges 86 and 90 of the die 14 and counter die 22 to attach these two components to one another at this location. Also as shown in FIG. 6, the die 14 and counter die 22 can be moved into position next to a female magnetic cylinder 34 and a male magnetic cylinder 38. The cylinders 34 and 38 can be configured in a variety of different manners in order to be magnetic. In one exemplary embodiment, at least one row of neodymium magnets 34 can be arranged around the circumference of the female magnetic cylinder 34 in order to cause cylinder 34 to be magnetic. In a similar manner, at least one row of neodymium magnets 40 are arranged around the male magnetic cylinder 38 to likewise impart magnetism thereto.

In accordance with one exemplary embodiment of mounting the die 14 and counter die 22, the taped leading edges 86 and 90 can be moved into the position shown in FIG. 6 in which the leading edge 90 of counter die 22 is engaged onto a register location 104 located on the male magnetic cylinder 38. Register location 104 can be a register scribe or register pin on the male magnetic cylinder 38 in accordance with various exemplary embodiments.

Figure 7:
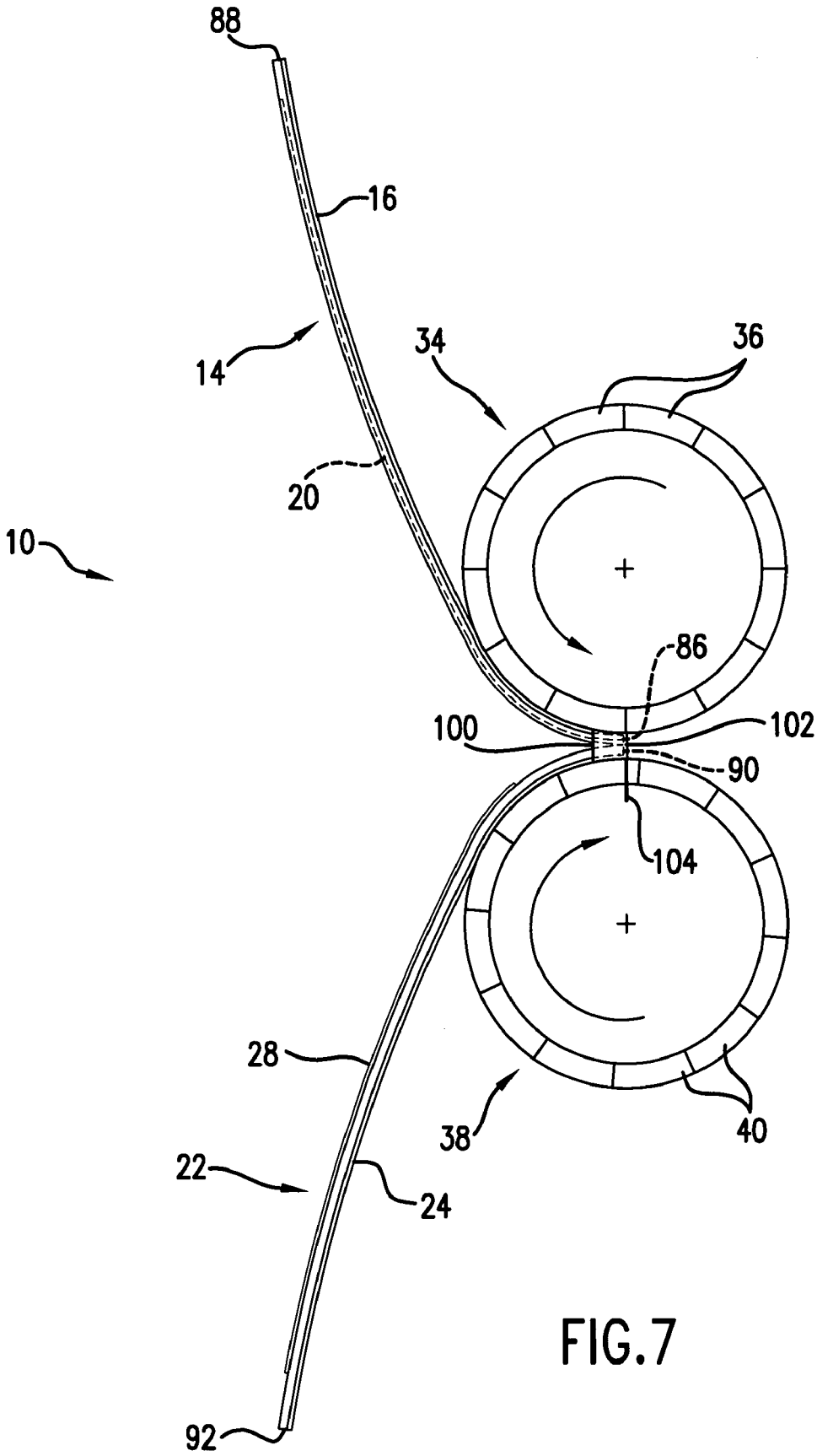
FIG. 7 is a side view of the male and female cylinders advanced from their position in FIG. 6.
Figure 8:
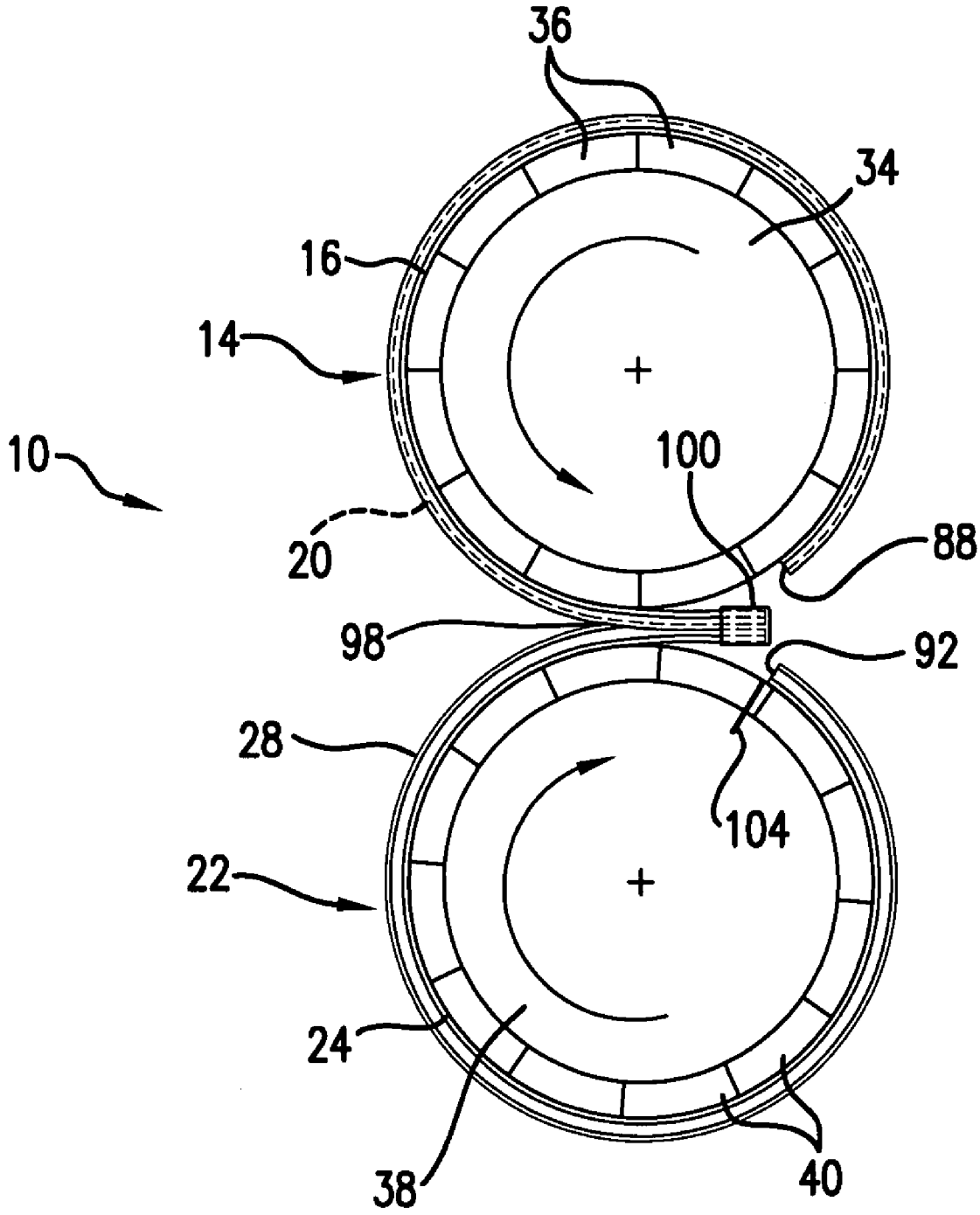
FIG. 8 is a side view of the male and female cylinders advanced from their position in FIG. 7 in which taped leading edges of the die and counter die are moved through a nip formed by the male and female cylinders.

The female magnetic cylinder 34 and male magnetic cylinder 38 can be rotated so that the leading portion of metal backing layer 16 of die 14 magnetically engages female magnetic cylinder 34 and so that the leading portion of metal backing layer 24 of counter die 22 magnetically engages male magnetic cylinder 38. This advancement and engagement is shown in FIG. 7 in which the leading edges 86 and 90 are located in a nip 102 formed by the female magnetic cylinder 34 and male magnetic cylinder 38.

Figure 9:
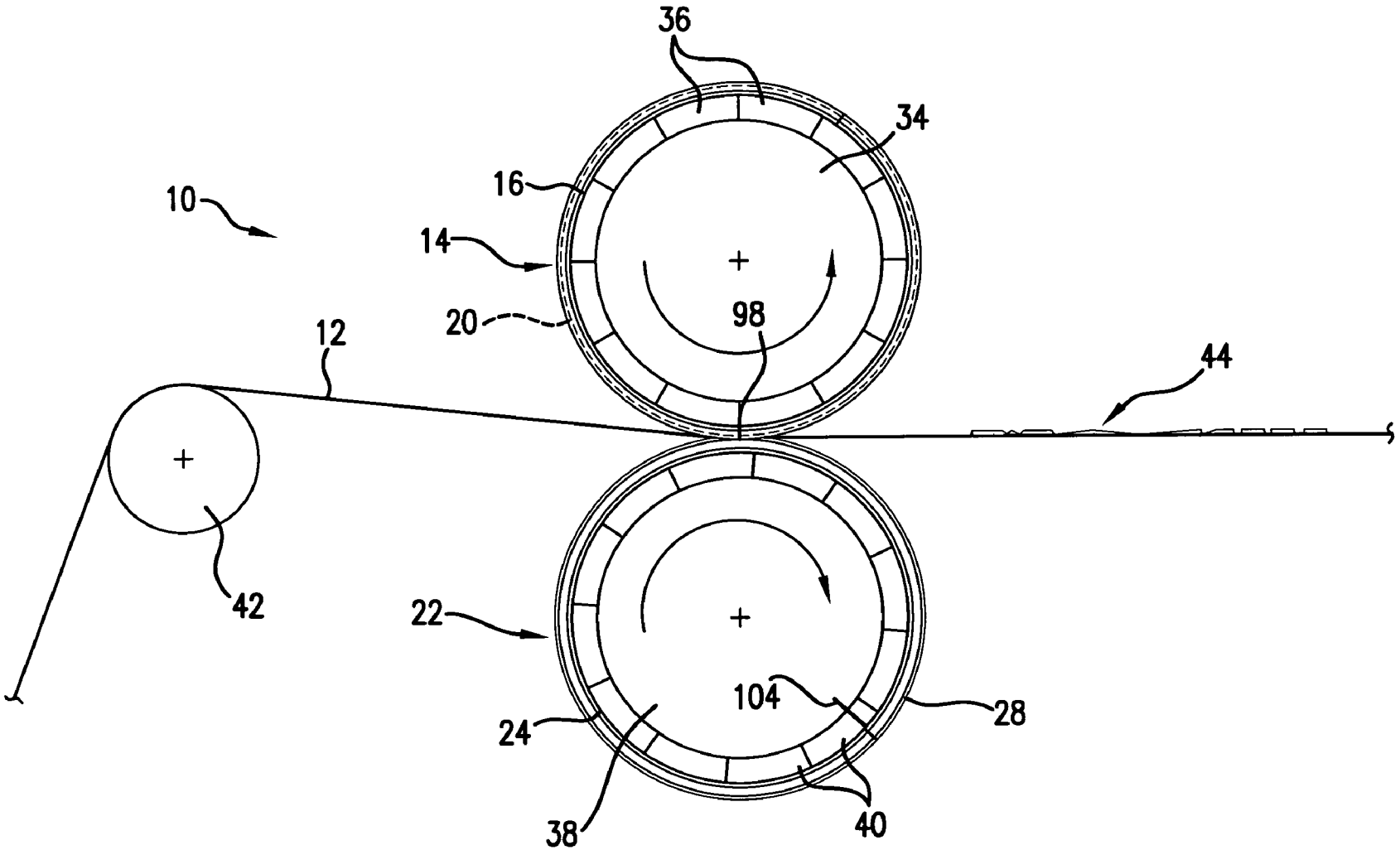
FIG. 9 is a side view of the male and female cylinders advanced from their position in FIG. 8 with the die and counter die completely attached.

The female magnetic cylinder 34 and male magnetic cylinder 38 can be continued to be rotated until the taped leading edges 86 and 90 are moved out of nip 102 and are positioned a slight distance therefrom. For example, the taped leading edges 86 and 90 may be moved a distance of one inch from nip 102 in accordance with one exemplary embodiment. At this point, a user may stop rotation of the female magnetic cylinder 34 and male magnetic cylinder 38 and remove tape 100. Doing so allows the metal backing layers 16 and 24 to magnetically attach to the male and female magnetic cylinders 38 and 34 as they are rotated. Complete engagement of metal backing layers 16 and 24 is shown in FIG. 9 in which the die 14 and counter die 22 are shown to be completely mounted onto the male and female magnetic cylinders 38 and 34. Interlocking of the female register tract 54 and male register tract 56, in addition to the second female register tract 58 and second male register tract 60, helps keep the die 14 and counter die 22 in register with one another during their rotation. If desired, lock down pressure can be applied between the female magnetic cylinder 34 and male magnetic cylinder 38 in order to create a nip 98 between the embossing plates of a desired pressure.

FIG. 9 also shows an idle roller 42 positioned proximate the female magnetic cylinder 34 and male magnetic cylinder 38. A substrate 12 such as paper, foil or other material may be passed over the idle roller 42 and directed first onto the polymer layer 18 of die 14. Doing so may be advantageous in stopping or limiting creasing, registration and tension problems that may occur during embossing of the substrate 12. However, it is to be understood that in other embodiments the substrate 12 may first contact the polymer layer 26 of counter die 22 or may simultaneously contact polymer layers 18 and 26. Further, it is to be understood that the presence of idle roller 42 is not necessary in other embodiments. The substrate 12 can if desired be heated before being passed through a nip 98 formed by polymer layers 18 and 26 of die 14 and counter die 22. Doing so may help prevent tearing of the substrate 12 when embossing high profile shapes. Passing of substrate 12 through nip 98 causes the male pattern 28 on counter die 22 to press the substrate 12 into the female pattern 20 on die 14. This application of pressure causes an embossing 44 to be formed on the substrate 12.

A variety of manufacturing processes may be used to construct the different components of the apparatus 10. The metal backing layers 16 and 24 can be thin sheets that may be up to 0.008 inches in thickness in accordance with one embodiment. The polymer layers 18 and 26 can be vulcanized, bonded or otherwise applied to the metal backing layers 16 and 24 in strips that are 24 inches wide by 30 feet long. The combined layers 16 and 18, along with combined layers 24 and 26, may be ground to various thicknesses such as 0.029 inches, 0.034 inches, 0.039 inches, 0.045 inches and/or 0.065 inches. It is to be understood, however, that the combined layers 16 and 18, in addition to combined layers 24 and 26, may be from 0.010 inches to 0.25 inches in thickness in accordance with certain exemplary embodiments. The thickness of the counter die 22 is generally subject to the substrate 12 that is being embossed. The outside diameter of the die 14 is usually made to match the true pitch diameter of the female magnetic cylinder 34 to which the die 14 is mounted. The combined layers 16, 18 and 24, 26 can then be cut to sheets of 24 inches by 36 inches in size.

The combined layers 16, 18 and 24, 26 can then be attached to a magnetic cylinder in a rotary laser engraver. The laser engraver may then ablate into polymer layers 18 and 26 patterns 20 and 28 having desired shapes, depths and distortions. The laser engraver may also ablate the starting members 46, 48, 50, 52, 78 and 80 into the polymer layers 18 and 26. Still further, the female register tract 54, male register tract 56, second female register tract 58 and second male register tract 60 can also be ablated into polymer layers 18 and 26. The starting members and register tracts can be ablated into the waste area of the polymer layers 18 and 26 so that their image is not imparted onto the substrate 12 during the embossing process.

The male pattern 28 can be formed with a 2.5 pixel soft shoulder/edge in accordance with one exemplary embodiment of the present invention in order to reduce possible tearing of the substrate 12 on embossed edges. The female pattern 20 can be provided with hard edges. After or during laser engraving, the die 14 and counter die 22 can be pre-bent or rolled. Pre-bending or rolling is shown in FIG. 5. A 100 step 8 bit TIF file may be used to calibrate the laser engraver to image a full tonal range from highlights to shadows. Each step may be adjusted to 1/100 addition of total relief. The depth of example step 25 will be adjusted to be ¼ the overall relief depth, and step 50 will be adjusted to be ½ of the overall relief depth and so forth. Software is employed in order to convert 8 bit TIF and vector art into a series of micro lines having varying thicknesses, angles and spacing on the same die 14 or counter die 22 to generate a holographic illusion. Typically, the laser engraver employed utilises a modulated laser. A single laser may be used if a dual laser system is employed in which the second laser is dormant. The die 14 and counter die 22 can be washed with water once laser engraving is completed. Although described as employing lasers to manufacture various features of the die 14 and counter die 22, it is to be understood that other machines and processes may be used to construct the aforementioned elements or features of the apparatus 10.

The female and male magnetic cylinders 34 and 38 may be ground under true pitch diameter otherwise known as undercuts or bare cylinder diameter. The undercuts or bare cylinder diameter is provided in order to match product repeat lengths and die 14 and counter die 22 thickness. The die 14 and counter die 22 can be manufactured to fit magnetic cylinders 24 and 38 with an undercut of 0.019 inches, 0.029 inches and/or 0.045 inches. The counter die 22 is usually between 0.001 inches to 0.029 inches thicker than the die 14 and stands higher than the true pitch diameter of the male magnetic cylinder 38. Utilisation of 0.019 inch undercut male magnetic cylinders 38 and 0.029 inch undercut female magnetic cylinders 34 with 0.029 inch dies 14 reduces the laser image time by half. This is because both die 14 and counter die 22 can be imaged simultaneously because the focus of the laser engraver is identical. This situation is contrasted to that in which a 0.029 inch die and a 0.039 inch counter die are employed that requires different optical focus from one another.

The apparatus 10 may be arranged so that a counter die 22 of 0.029 inches and 0.034 inches on a 0.019 inch undercut male magnetic cylinder 38 is present. Alternatively, a 0.69 inch counter die 22 may be used on a 0.045 inch undercut male magnetic cylinder 38. The die 14 can be made to match the undercut or bare cylinder diameter to which the die 14 is mounted such as 0.029 inches and 0.045 inches. The female magnetic cylinder 34 and male magnetic cylinder 38 are manufactured to match the product's repeat length and width with the required undercut or bare cylinder diameter best suited for the thickness of the substrate 12 to which the embossing 44 is applied. The disclosed process can be used in current presses, converting equipment and finishing equipment with an existing die station. Further, the current process may be used in a stand alone station and/or in embossing modules. The present process may make use of a customer's current printing and/or converting equipment and allows for embossing in line as a one pass process. The current process allows for 2D embossing 44 to be produced in which the embossed image has a single height. Additionally, 3D embossing can be accomplished in accordance with the present invention in which the embossed image has multiple levels, heights and contours.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. An apparatus for embossing a substrate, comprising:

a die having a metal backing layer that carries a polymer layer, the polymer layer having first and second female register tracts formed thereon through the use of laser engraving, said metal backing layer capable of being magnetically attached to a magnetic cylinder;

a counter die having a metal backing layer that carries a polymer layer, wherein said polymer layer of said counter die has first and second male register tracts formed thereon through the use of laser engraving, the first and second male register tracts receivable into the respective first and second female register tracts in order to maintain the die and counter die in register with one another during rotation of the die and counter die, wherein said metal backing layer of said counter die is capable of being magnetically attached to a magnetic cylinder, and wherein said male and said female register tracts have an elongated rectangular shaped component with spokes extending perpendicular to the direction of elongation, and wherein said second male register tract and said second female register tract have an elongated rectangular shaped component with spokes extending perpendicular to the direction of elongation.

2. An apparatus for embossing a substrate, comprising:

a die having a polymer layer that has a female pattern thereon, wherein said die is capable of being attached to a cylinder, wherein said polymer layer of said die has a female register tract thereon; and a counter die having a polymer layer that has a male pattern thereon, wherein said counter die is capable of being attached to a cylinder, wherein said polymer layer of said counter die has a male register tract thereon;

wherein said male register tract is receivable into said female register tract in order to maintain said die and said counter die in register with one another during rotation of said die and said counter die; and wherein said male and said female register tracts have an elongated rectangular shaped component with spokes extending perpendicular to the direction of elongation, and wherein said male register tract is located outside of said pattern of said polymer layer of said counter die, and wherein said female register tract is located outside of said pattern of said polymer layer of said die.

3. The apparatus as set forth in claim 2, wherein said female register tract has a pair of elongated grooves and wherein said elongated rectangular shaped component of said female register tract is located between said pair of elongated grooves, and wherein said male register tract has a pair of elongated rectangular shaped edges and wherein said elongated rectangular shaped component of said male register tract is located between said pair of elongated rectangular shaped edges, and wherein said pair of elongated rectangular shaped edges are receivable into said pair of elongated grooves.

4. A method of mounting a die and a counter die for use in embossing, comprising the steps of:

providing a die having a metal backing layer that carries a polymer layer, wherein said polymer layer has a female pattern thereon;

providing a counter die having a metal backing layer that carries a polymer layer, wherein said polymer layer has a male pattern thereon;

providing a female magnetic cylinder;

providing a male magnetic cylinder;

magnetically attaching said metal backing layer of said die to said female magnetic cylinder;

magnetically attaching said metal backing layer of said counter die to said male magnetic cylinder, wherein said polymer layer of said die and said polymer layer of said counter die form a nip;

taping a leading edge of said die to a leading edge of said counter die;

engaging said counter die onto a register location of said male magnetic cylinder;

rotating said female magnetic cylinder and said male magnetic cylinder such that the leading edges of said die and said counter die are passed through a nip formed by said male magnetic cylinder and said female magnetic cylinder;

removing tape from said leading edges of said die and said counter die; and rotating said female magnetic cylinder and said male magnetic cylinder such that said step of magnetically attaching said metal backing layer of said die to said female magnetic cylinder and said step of magnetically attaching said metal backing layer of said counter die to said male magnetic cylinder is accomplished.

* * * * *